US009392884B2

(12) United States Patent
Juric

(10) Patent No.: US 9,392,884 B2
(45) Date of Patent: Jul. 19, 2016

(54) TILTED PUSHER TRAY

(71) Applicant: Nicholas C. Juric, Rockford, IL (US)

(72) Inventor: Nicholas C. Juric, Rockford, IL (US)

(73) Assignee: Southern Imperial, Inc., Rockford, IL (US)

( * ) Notice: Subject to any disclaimer, the term of this patent is extended or adjusted under 35 U.S.C. 154(b) by 106 days.

(21) Appl. No.: 14/152,619

(22) Filed: Jan. 10, 2014

(65) Prior Publication Data

US 2015/0196138 A1 Jul. 16, 2015

(51) Int. Cl.
*A47F 1/12* (2006.01)
*A47F 5/00* (2006.01)

(52) U.S. Cl.
CPC ..... *A47F 1/126* (2013.01); *A47F 5/0025* (2013.01); *A47F 5/005* (2013.01)

(58) Field of Classification Search
CPC ..... A47F 1/12; A47F 1/121; A47F 1/125; A47F 1/126; A47F 1/128
USPC ..... 211/59.3
See application file for complete search history.

(56) References Cited

U.S. PATENT DOCUMENTS 2,110,299 A * 3/1938 Hinkle ..... 211/59.3
2,954,129 A * 9/1960 Gordon ..... 211/59.3
4,303,162 A * 12/1981 Suttles ..... 211/59.3
4,331,243 A * 5/1982 Doll ..... 211/59.2
4,504,100 A * 3/1985 Chaumard ..... 312/71
4,730,741 A * 3/1988 Jackle et al. ..... 211/59.3
4,836,390 A * 6/1989 Polvere ..... 211/59.3
5,012,936 A 5/1991 Crum
5,027,957 A * 7/1991 Skalski ..... 211/59.3
5,069,349 A 12/1991 Wear et al.
5,088,607 A * 2/1992 Risafi et al. ..... 211/59.3
5,131,563 A * 7/1992 Yablans ..... 221/92
5,161,702 A * 11/1992 Skalski ..... 211/59.3
5,240,124 A * 8/1993 Buday ..... 211/59.2
5,240,125 A * 8/1993 Kunz ..... 211/59.3
5,240,126 A * 8/1993 Foster et al. ..... 211/59.3
5,665,304 A 9/1997 Heinen et al.
5,673,801 A 10/1997 Markson
5,855,283 A 1/1999 Johnson
5,992,653 A * 11/1999 Anderson et al. ..... 211/59.3
6,082,558 A 7/2000 Battaglia
6,142,317 A 11/2000 Merl
6,364,136 B1 4/2002 Weshler et al.

(Continued)

FOREIGN PATENT DOCUMENTS

EP 0083260 A1 * 7/1983
EP 1174060 A1 * 1/2002 ..... A47F 5/00

(Continued)

*Primary Examiner* — Stanton L Krycinski
(74) *Attorney, Agent, or Firm* — Reinhart Boerner Van Deuren P.C.

(57) ABSTRACT

A retail merchandise pusher tray is provided. The tray includes a base structure that includes at least one divider mounted to the base structure and extending upwardly from the base structure. A front stop is mounted at the front end of the base structure. At least one pusher is slidably mounted to the base structure. The pusher further includes a bottom wall and a pair of sidewalls extending upwardly from the bottom wall in an opposed space relation. A front wall of the pusher extends upwardly from the bottom wall. The front wall includes a base portion and a projection portion. The projection portion extends upwardly and diagonally away from the base portion to an upper edge. The upper edge of the projection portion is forward of the base portion.

7 Claims, 6 Drawing Sheets

(56) References Cited

U.S. PATENT DOCUMENTS

| | | | | |
|---|---|---|---|---|
| 6,378,727 | B1 * | 4/2002 | Dupuis et al. | 221/92 |
| 6,691,891 | B2 * | 2/2004 | Maldonado | 221/279 |
| 6,719,152 | B1 | 4/2004 | Nagel et al. | |
| 6,745,906 | B1 | 6/2004 | Nagel | |
| 6,866,155 | B2 | 3/2005 | Nagel | |
| 6,866,156 | B2 | 3/2005 | Nagel et al. | |
| 6,886,699 | B2 * | 5/2005 | Johnson et al. | 211/59.3 |
| 6,886,700 | B2 | 5/2005 | Nagel | |
| 6,889,855 | B2 | 5/2005 | Nagel | |
| 6,955,269 | B2 * | 10/2005 | Menz | 211/59.3 |
| 7,032,761 | B2 | 4/2006 | Nagel | |
| 7,168,579 | B2 * | 1/2007 | Richter et al. | 211/59.3 |
| 7,419,062 | B2 | 9/2008 | Mason | |
| 7,458,473 | B1 | 12/2008 | Mason | |
| 7,681,744 | B2 | 3/2010 | Johnson | |
| 7,690,519 | B2 | 4/2010 | Kahl et al. | |
| 7,819,281 | B2 * | 10/2010 | Guindulain Busto | 221/120 |
| 7,823,734 | B2 * | 11/2010 | Hardy | 211/59.3 |
| 7,854,334 | B2 | 12/2010 | Nagel et al. | |
| 7,896,171 | B2 * | 3/2011 | Battaglia | 211/59.2 |
| 7,926,668 | B2 * | 4/2011 | Barkdoll | 211/59.3 |
| 7,931,156 | B2 | 4/2011 | Hardy | |
| 8,016,128 | B2 * | 9/2011 | Valiulis et al. | 211/59.3 |
| 8,210,367 | B2 | 7/2012 | Nagel et al. | |
| 8,328,027 | B2 * | 12/2012 | Barkdoll | 211/59.3 |
| 8,413,825 | B2 * | 4/2013 | Spizman et al. | 211/184 |
| 8,453,850 | B2 * | 6/2013 | Hardy | 211/59.3 |
| 8,453,851 | B2 | 6/2013 | Ciesick | |
| 8,561,817 | B1 | 10/2013 | Allen | |
| 9,016,483 | B2 * | 4/2015 | Howley | 211/59.3 |
| 9,038,833 | B2 * | 5/2015 | Ciesick | 211/59.3 |
| 2003/0057167 | A1 * | 3/2003 | Johnson et al. | 211/59.3 |
| 2004/0065631 | A1 | 4/2004 | Nagel | |
| 2005/0092703 | A1 | 5/2005 | Mueller et al. | |
| 2005/0127014 | A1 | 6/2005 | Richter et al. | |
| 2006/0113262 | A1 * | 6/2006 | Knorring et al. | 211/59.2 |
| 2006/0186065 | A1 | 8/2006 | Ciesick | |
| 2006/0273053 | A1 | 12/2006 | Roslof et al. | |
| 2007/0175839 | A1 | 8/2007 | Schneider et al. | |
| 2007/0194037 | A1 * | 8/2007 | Close | 221/100 |
| 2010/0025346 | A1 | 2/2010 | Crawbuck et al. | |
| 2010/0108624 | A1 | 5/2010 | Sparkowski | |
| 2010/0176075 | A1 | 7/2010 | Nagel et al. | |
| 2010/0176077 | A1 | 7/2010 | Nagel et al. | |
| 2011/0017684 | A1 | 1/2011 | Nagel et al. | |
| 2011/0100942 | A1 * | 5/2011 | Spizman et al. | 211/150 |
| 2011/0210086 | A1 | 9/2011 | Ciesick | |
| 2012/0211450 | A1 | 8/2012 | Kologe | |
| 2012/0255924 | A1 | 10/2012 | Kologe | |
| 2013/0037562 | A1 * | 2/2013 | Close | 221/279 |
| 2013/0112634 | A1 | 5/2013 | Nagel | |
| 2013/0200026 | A1 * | 8/2013 | Bryson et al. | 211/126.14 |

FOREIGN PATENT DOCUMENTS

| | | | | |
|---|---|---|---|---|
| FR | 2542591 | A1 * | 9/1984 | |
| FR | 2690824 | A1 * | 11/1993 | A47F 5/01 |

* cited by examiner

TILTED PUSHER TRAY

FIELD OF THE INVENTION

This invention generally relates to retail merchandise displays, and more particularly to self-facing retail merchandise displays for biasing retail merchandise forward.

BACKGROUND OF THE INVENTION

The retail industry customarily uses self-facing merchandise display trays which are also commonly referred to as auto-facing merchandise displays. An example of such a display tray is seen for example in United States Patent Publication No. 2013/0112634. These trays incorporate a biasing member in the form of pushers, pusher paddles, or pusher bodies to move retail merchandise to the front of a display tray.

The movement of the retail merchandise to the front of the merchandise display tray in turn places the retail merchandise at the front of the retail merchandise shelf since in most situations the tray is mounted on top of the retail merchandise shelf. Use of the self-facing retail merchandise tray with biased pushers is desirable because the use thereof avoids the manual labor once required by store employees who would walk the store and move individual items of retail merchandise from the back of a store shelf to the front of the store shelf. Such activity is commonly referred to as facing the shelves. The front facing of the retail merchandise on the trays and thus, on the shelf upon which the trays rest, allows customers to easily see and select an item of retail merchandise for purchase.

Accordingly, self-facing retail merchandise display trays are critical in reducing labor costs associated with manual facing of retail merchandise displays. Additionally, profitability is increased with retail merchandise at the front of a store shelf because of its increased visibility to the consumer, ease of access, and an overall aesthetically pleasing appearance of a well-organized and well-kept store which in turn ensures repeat as well as new customers.

Traditional trays with self-facing pushers have not proven adequate in auto-facing some types of cylindrical shaped merchandise. For example, cylindrical spray paint cans. Specifically, these cylindrical cans have protruding rings around the bottom of the can. As an intermediate can, that is, a can sandwiched between a preceding can and a succeeding can moves forward to the front of the shelf on the pusher biased tray, its protruding ring slides over the top of the ring of the preceding can and the immediately succeeding can. This type of problem is illustrated in FIG. 11.

When an intermediate can has been pushed into this configuration it rides on the protruding rings of the preceding and succeeding cans. Undesirable problems arise when a consumer selects a front faced can to remove from the display tray. More particularly, as the can that is nearest the front stop of the tray is selected by the consumer and lifted from the retail merchandise channel within the tray, the succeeding can is lifted because its protruding ring is over the top of the protruding ring of the can that is being lifted out of the display. That is, instead of the consumer being able to lift just one can, two cans are lifted. When two cans are lifted from the tray the cans may be moved out of the desired linear array within the retail merchandise channel of the tray such that the self-facing pusher is not able to move freely to bias, that is push, the remaining merchandise to the front of the display. Further, the succeeding can that was not intended to have been lifted by the consumer may fall from the retail display as the selected can is lifted. When this happens, the cans, often times under pressure, as is the case for example with cylindrical spray paint cans, can be damaged during the fall.

Accordingly, there is a need in the art for a pusher that can bias cylindrical merchandise forward in an auto-facing retail merchandise display so that when a cylindrical can is selected the succeeding can does not fall from the display or become so displaced within the retail merchandise channel that the self-facing biasing is interrupted.

The invention provides such a pusher. These and other advantages of the invention, as well as additional inventive features, will be apparent from the description of the invention provided herein.

BRIEF SUMMARY OF THE INVENTION

In one aspect, a retail merchandise pusher tray is provided. The embodiment of the merchandise pusher tray according to this aspect includes a base structure having at least one divider mounted to the base structure and extending upwardly from the base structure. A front stop is mounted at a front end of the base structure. At least one pusher is slidably mounted to the base structure. The pusher further includes a bottom wall and a pair of sidewalls extending upwardly from the bottom wall in an opposed space relation. A front wall of the pusher extends upwardly from the bottom wall. The front wall includes a base portion and a projection portion. The projection portion extends upwardly and diagonally away from the base portion to an upper edge. The upper edge of the projection portion is forward of the base portion.

The base structure can include a floor over a rectangular support structure. The floor may be comprised of wire members. The floor is mounted on top of the rectangular support structure. The at least one divider can include a pair of wire dividers arranged in opposed space relationship to define a retail merchandise channel. The front stop may be removable from the base structure. In yet other embodiments the front stop may be fixedly attached to the base structure at the front end of the tray. The front wall of the at least one pusher can include a back surface. The back surface can support a plurality of rib members in proximately parallel relation to the pair of side walls. The bottom wall of the at least one pusher includes an attachment arrangement. The attachment arrangement includes a pair of apertures. Each aperture permits a snap fit of a longitudinal member of the base structure.

In another aspect, a merchandise pusher tray is provided. An embodiment of a merchandise pusher tray according to this aspect includes a base structure and at least one divider mounted to the base structure and extending upwardly therefrom. A front stop is mounted at the front end of the base structure and the at least one pusher is slidably mounted to the base structure. The at least one pusher further includes a bottom wall and a top wall in opposed space relation to the bottom wall. A pair of side walls extends upwardly from the bottom wall in an opposed space relation and interposed between the bottom wall and the top wall. A front wall extends upwardly from the bottom wall to an uppermost edge. A depression is formed at the uppermost edge such that the depression forms a portion of the front wall and a portion of the top wall.

The base structure may include a rectangular support structure and a floor supported by the rectangular support structure. The floor may be comprised of wire members that include a plurality of longitudinal members in opposed space relationship and a plurality of horizontal members in opposed space relationship. A portion of each of the plurality of longitudinal members may be joined transversely to a portion of each plurality of horizontal members.

The rectangular support structure may include at least two horizontal bar members in opposed space relation and at least two longitudinal corner plate members in opposed space relation. The at least two horizontal bar members may be joined to the at least two longitudinal corner plate members proximate to ends thereof. The retail merchandise pusher tray of this embodiment may further include a curved front stop. In yet other embodiments the front stop may be flat. Further, the at least one divider may include a pair of wire dividers. Each divider may include a top longitudinal wire member over bottom longitudinal wire member in opposed space relation.

A first viewing window may be provided between the top and bottom longitudinal wire members and a second viewing window may be provided between the bottom longitudinal wire members and the floor. The pusher may include a cavity that provides for a biasing member. There may be a terminus end of the biasing member that is extendable through an attachment arrangement of the bottom wall to the front stop. The top wall of the pusher may further include a depression having a radius of curvature sized to approximate a radius of curvature of an item of retail merchandise.

In yet another aspect, a merchandise pusher tray is provided. An embodiment of a pusher tray according to this aspect includes a base structure and at least one divider mounted to the base structure and extending upwardly therefrom. A front stop may be mounted at a front end of the base structure and at least one pusher may be slidably mounted to the base structure. The at least one pusher may include a bottom wall and a top wall in opposed space relation to the bottom wall. A pair of side walls may extend upwardly from the bottom wall in an opposed space relation and interposed between the bottom wall and the top wall. A front wall may extend upwardly from the bottom wall. A retail merchandise support depression may form at least a portion of the front wall and the top wall. The retail merchandise support depression may have a radius of curvature which is sized to approximate a radius of curvature of a generally cylindrical item of retail merchandise such that the generally cylindrical item of retail merchandise is positioned within the retail merchandise support depression.

The base structure may include a wire floor mounted on top of a rectangular support structure. The wire floor may be in direct contact with the retail merchandise when the retail merchandise is mounted thereon. The rectangular support structure may include two hook members in opposed space relation configured for receipt of a portion of a front face of a retail merchandise shelf. The front stop of the pusher tray may include a retailer merchandise label holder. The at least one divider of the retail merchandise pusher tray may include a pair of wire dividers in opposed space relation and mounted to the wire floor of the base structure. The top wall of the pusher includes a vertical member proximately perpendicular to the top wall of the pusher. The vertical member extends between the pair of side walls and upwardly from the top wall. A forward most edge of the top wall can extend over a forward most edge of the bottom wall. The forward most edge of the top wall may include the retail merchandise support depression therein.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
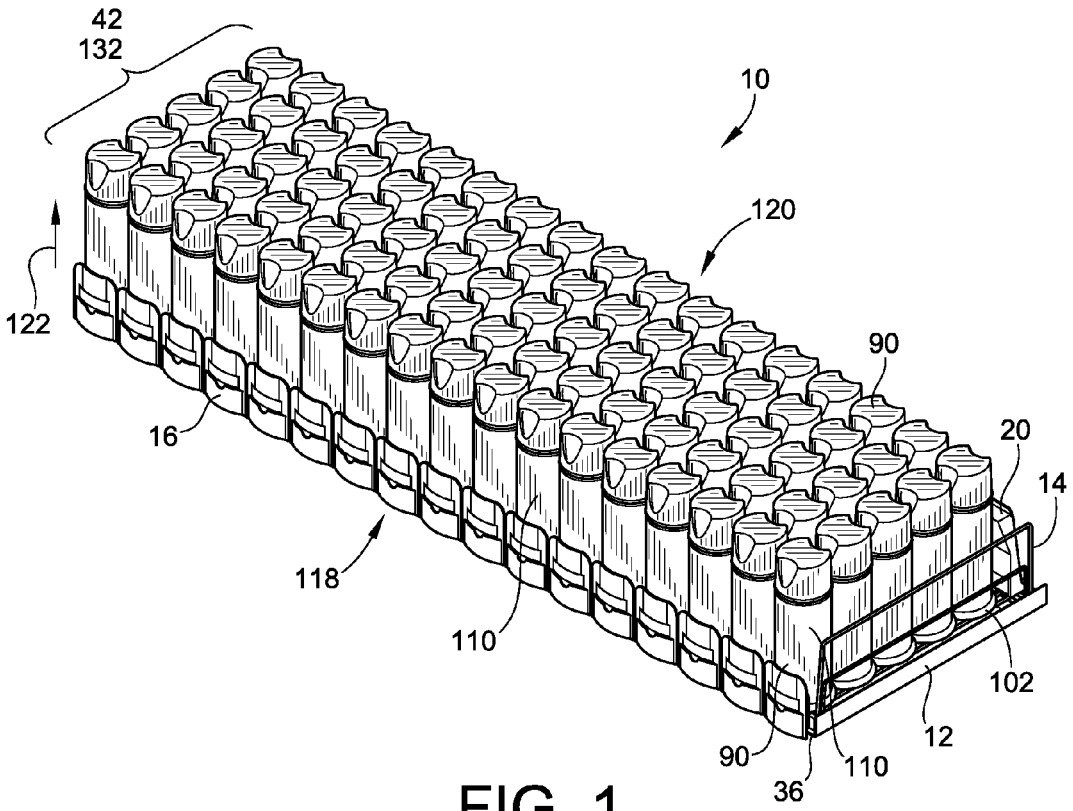
FIG. 1 is a perspective view of a retail merchandise pusher tray and cylindrical cans of retail merchandise mounted thereon.

Turning now to the drawings, FIG. 1 illustrates an embodiment of a self-facing retail merchandise tilted pusher tray 10 (hereinafter "tray"). The tray 10 is designed to be placed on a retail merchandise shelf and to have retail merchandise mounted on the tray. The retail merchandise consists of a plurality of cylindrical cans 90 of the type frequently associated with cans of spray paint that have a protruding ring 102 at the bottom 91 of the can 90.

Continuing with FIG. 1, further illustrated is a tilted pusher 20 at the back 120 of the tray 10. The tilted pusher 20 is shown biasing four cans 90 to the front 118 of the tray 10. This position of the retail merchandise at the front 118 of the tray 10 and thus at the front of the retail merchandise shelf is what was previously discussed above as the desired position of the retail merchandise, that is faced, front faced or auto faced, terms used interchangeably in the art.

FIG. 1 illustrates an embodiment of the tray 10 with seventeen rows of cans 90 in columns of five cans 90 in a linear array 132 situated on the tray 10 from the front 118 of the tray 10 to the back 120 of the tray 10. The tilted pusher 20 in the back of each column is shown biasing the cans 90 to the front stop 16 at the front 118 of the tray 10. However, the embodiment is not limited to that which is shown in FIG. 1. For example, the tray 10 may comprise only a single row and column or an embodiment of the tray 10 may have any number of rows and columns as desired.

FIG. 1. also illustrates the front stop 16 may be curved, although in yet other embodiments the front stop 16 may be flat (not shown). The front stop receives the cylindrical outer surface 116 of a can 90 thus ensuring a tight fit of all the cans 90 in the linear array 132 within a retail merchandise channel 42. By linear array 132 it is meant that the cans 90 are in a retail merchandise channel 42 defined by the front stop 16, the tilted pusher 20, and a pair of dividers 40. The front stop 16 receives the cylindrical surface 116 of the front faced can 110 while a cylindrical surface 116 of the can 90 at the back 120 of the tray 10 is received into a mating cylindrical surface 130 of retail merchandise support depression 54 of the tilted pusher 20.

Still with reference to FIG. 1, the front stop 16 cooperates with the advantageous tilted pusher 20 in back 120 of the tray 10 so as to keep the cans 90 in the particularly desired linear array 132 within the retail merchandise channel 42 as described in greater detail below.

Figure 2:
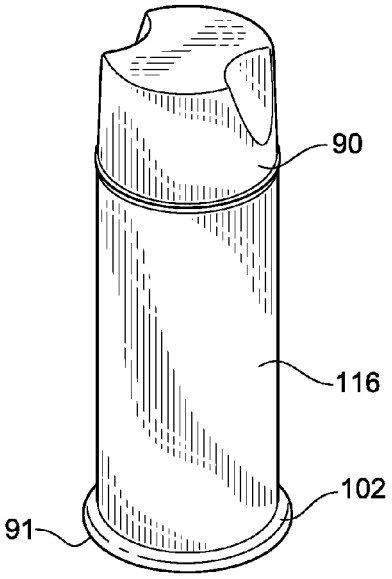
FIG. 2 is a perspective view of a cylindrical can of retail merchandise of the type with a protruding ring at the bottom of the can.

FIG. 2 illustrates a single cylindrical can 90 of FIG. 1. Illustrated in detail is the protruding ring 102 at the bottom 91 of the can 90 as well as the cylindrical outer surface 116 of the can 90 that mates with the front stop 16 at the front 118 of the tray 10 and with the retail merchandise support depression 54 of the tilted pusher 20 in the back 120 of the linear array 132 of the tray 10.

Figure 3:
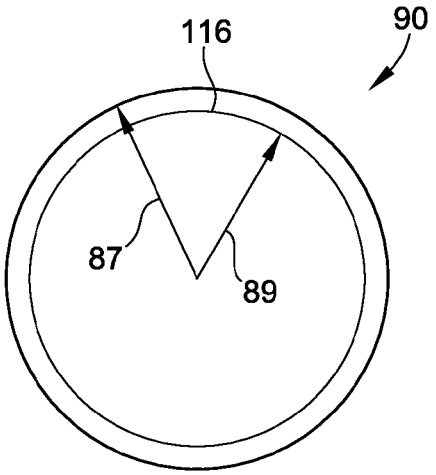
FIG. 3 is a top view of the cylindrical can of retail merchandise of FIG. 2.

FIG. 3 illustrates the top view of the can 90 of FIG. 2. The outer cylindrical surface 116 of the can 90 that is received into the retail merchandise depression 54 is shown. It can be readily appreciated from this top view that the radius of curvature 89 of the outer cylindrical surface 116 of the can 90 is less than radius of curvature 87 of the protruding ring 102 of the can 90.

Figure 4:
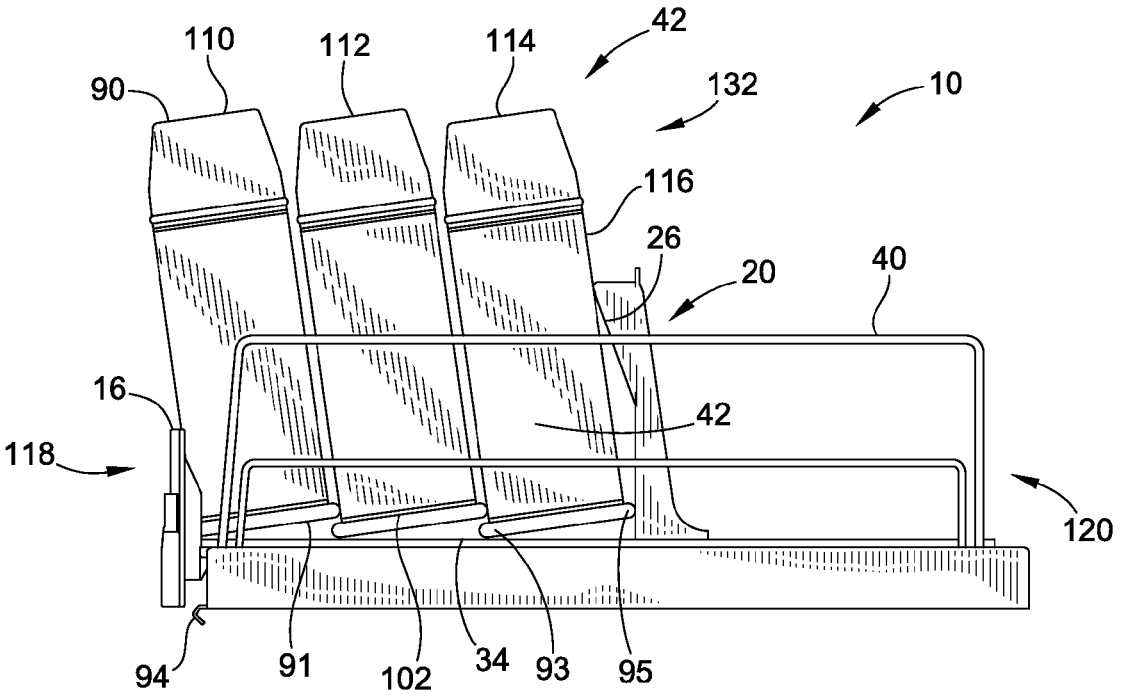
FIG. 4 illustrates a side view in perspective of the tray of FIG. 1 with the pusher producing a forward tilt of the cylindrical cans mounted thereon such that the protruding bottom rings of each can are in correct alignment.

As shown in FIG. 4, the biased linear array 132 of cans 90 within the retail merchandise channel 42 facilitates the removal by a consumer of a front faced can 110. The front faced can 110 is lifted from the tray 10 by the consumer without lifting the next; that is intermediate can 112 that is mounted behind the front faced can 110 and in front of succeeding can 114. As will be described in greater detail below, in general, the tilted pusher 20 has a front wall 26 tilted towards the front 118 of the tray 10. Further, the front wall 26 includes a retail merchandise depression 54 (See FIG. 5.) that receives the cylindrical surface 116 of the last can 114 in the linear array 132.

Continuing with reference to FIG. 4, the tilted pusher 20 with its retail merchandise depression 54 biases the cans towards the front 118 of the tray 10 and tilts the cans forward towards the front stop 16. Thus, the tilted pusher tilts the cans 110, 112,114 toward the front stop 16 such that only a front portion 93 of the bottom 91 of each can 110, 112, 114 is in contact with the floor 34 of the tray 10. The forward tilt of the cans 110, 112, 114 is such that the protruding rings 102 of each can maintain the proper relationship to one another as shown. Specifically, the front portions 93 of the bottoms 91 maintain contact with the floor 34 while the back portions 95 of the bottoms 91 do not contact the floor 34. Thus, the cans 110, 112, 114 maintain a tight fit and their protruding rings 102 maintain their proper relationship within the linear array 132 of cans 110, 112, 114 from the front stop 16 to the tilted pusher 20 within the retail merchandise channel 42. As can be readily appreciated, though three cans 110, 112, 114 are shown in the retail merchandise channel 42, the tray 10 is not limited to only three cans 90 and its various embodiments may provide for more or fewer cans 90.

Still with reference to FIG. 4, the advantageous tilt of the cans 110, 112, 114 is facilitated by the reception by the front stop 16 of the cylindrical outer surface 116 of the front faced can 110 in cooperation with the reception by the tilted pusher 20 in its retail merchandise support depression 54 of the cylindrical outer surface 116 of the last or succeeding can 114. Thus, the tilted pusher 20 in cooperation with front stop 16 within the retail merchandise channel 42 ensures not only the tight fit of the linear array 132 of cans 110, 112, 114 within the channel 42 but also the desired smooth transition of the intermediate can 112 to the front stop 16. That is, when the front faced can 110 is lifted by a consumer from the tray 10, then the intermediate can 112 is biased towards the front 118 of the tray 10 as it slides easily into place to be received by the front stop 16 awaiting the next consumer purchase. Meanwhile, simultaneously as with can 112, the remaining cans, that is succeeding cans 114 in the retail merchandised channel 42 also slide forward as they are biased by the tilted pusher 20 towards the front 118 of the tray 10.

Figure 5:
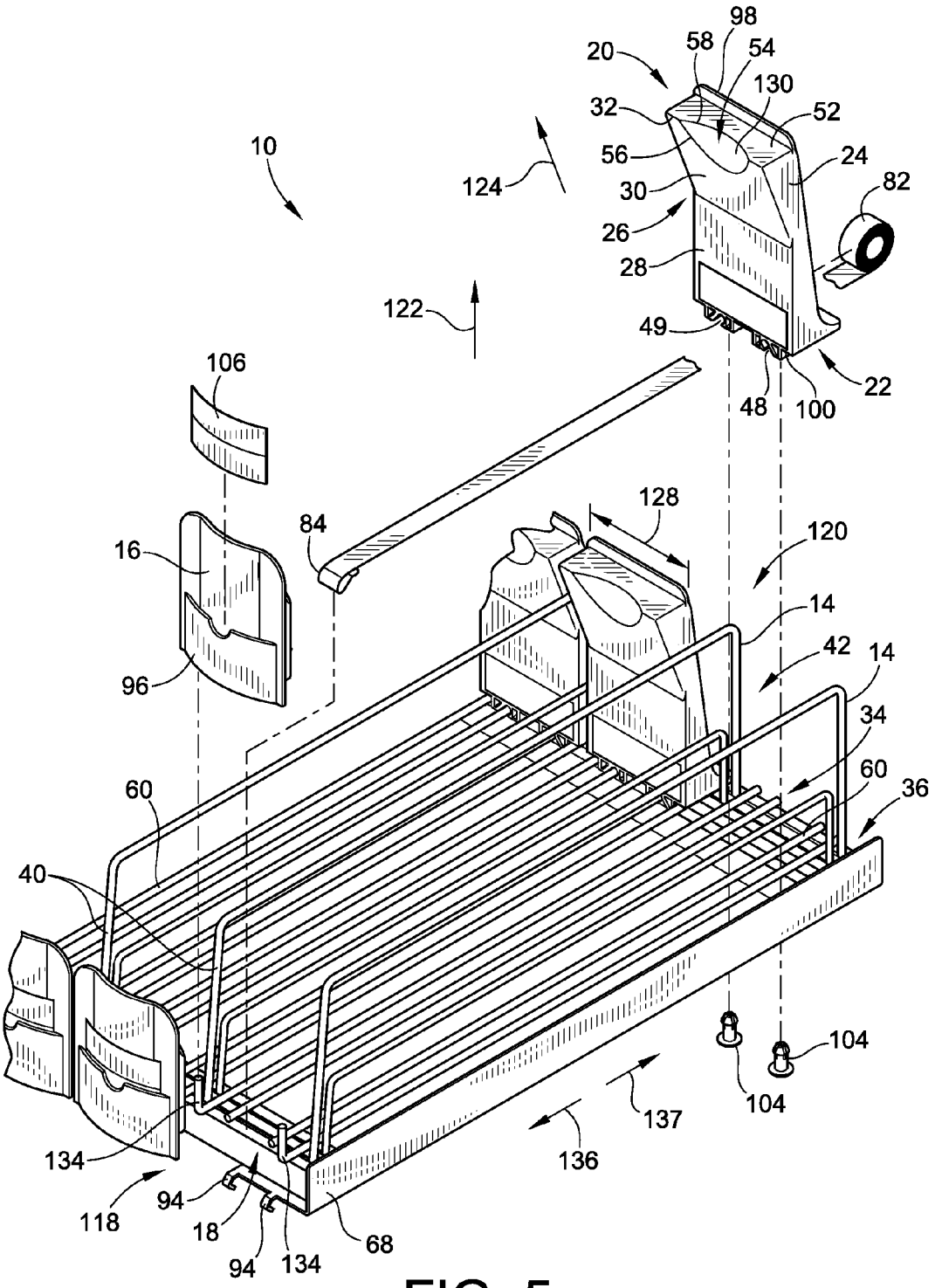
FIG. 5 is a partial assembly view of the pusher tray of FIG. 1.

Turning then to FIG. 5, an assembly view of the tray 10 is provided. The tray 10 includes a base structure 12 and at least one divider 14 mounted to the base structure 12 and extending upwardly 122 therefrom. The front stop 16 is mounted at a front end 18 of the base structure 12. The front stop 16 may be removable from the base structure and in particularly from the upturned ends 134 of the longitudinal members 60 of the floor 34. In certain embodiments, at least two of the longitudinal members 60 within any given retail merchandise channel 42 have an upturned end 134 at the front 118 of the tray 10 to receive the front stop 16 thereon. In yet other embodiments, the front stop 16 may be fixedly attached to the base structure 12 at the front end 18 of tray 10. In such embodiments the longitudinal members do not have upturned ends 134 at the front end 18 of the tray 10. The front stop 16 may further include a retail merchandise label holder 96 that receives a label 106. At the front of the tray 18 corner plate members 68 each include two hook members 94. Though, only two of the hooks are shown, it can be readily appreciated that a second of the two hook members 94 are included on the second of the two corner plate members 68. The hooks 94 allow for reception into a retail merchandise shelf. The two hook members 94 are in opposed spaced relation on each of corner plate 68 and configured for receipt of a portion of the front face of a retail merchandise shelf (not shown).

Still referring to FIG. 5, the tilted pusher 20 is slidably mounted to the base structure 12. The tilted pusher 20 includes a bottom wall 22, a pair of sidewalls 24 extending upwardly 122 from the bottom wall 22 in opposed space relation. The bottom wall 22 may have a biasing member 82 that sits atop the bottom wall 22. The tilted pusher 20 has a front wall 26 that extends upwardly 122 from the bottom wall 22 and includes a base portion 28. A projection portion 30 extends upwardly 122 and diagonally away 124 from the base portion 28 and towards the front 118 of the tray 10 to an upper edge 32 of the projection portion 30. It can be readily appreciated that the upward direction 122 means a vertical direction perpendicularly away from the base structure 12 of the tray 10. Diagonally away 124 means moving in a vectored direction having a vertical component in the upward direction 122 and a longitudinal component 136 directed away from the back 120 of the tray 10 towards the front 118 of the tray 10.

Continuing with reference to FIG. 5, the upper edge 32 of the projection portion 30 is closer to the front 118 of the tray 10 than is the forward most edge 100 of the bottom wall 22. In other words, the upper edge 32 of the projection portion 30 is forward of the base portion 28. The forward-most edge 32 of the projection portion 30 is also the forward most edge 32 of the top wall 52 and includes the retail merchandise support depression 54 therein. Further, the projection portion 30 of the front wall 26 of the titled pusher 20 includes a depression 54 that is formed at the upper-most edge 32 such that the depression 54 is formed into a portion 56 of the projection portion 30 of the front wall 26 and a portion 58 of a top wall 52 of the tilted pusher 20. A vertical member 98 extends the width 128 of the tilted pusher 20 and projects upwardly 122 and perpendicularly away from the top wall 52 to serve as a gripping tab. It is this advantageous structure of the projection portion 30 over the base portion 28 with the retail merchandise support depression 54 included in the projection portion 30 that facilitates the forward tilt of the cans 90 within the retail merchandise channel 42 that was previously discussed.

The tilted pusher 20 is moveable relative to the base structure 12 by means of the biasing member 82 in longitudinal direction 136 towards the front 118 of the tray 10 and also moveable in the longitudinal direction 137 towards the back of the tray 120. As previously discussed the biasing member 82 may be a coiled spring. A terminus end 84 of the biasing member 82 is extendable through an attachment arrangement 48 of the bottom wall 22 to the front stop 16.

Figure 6:
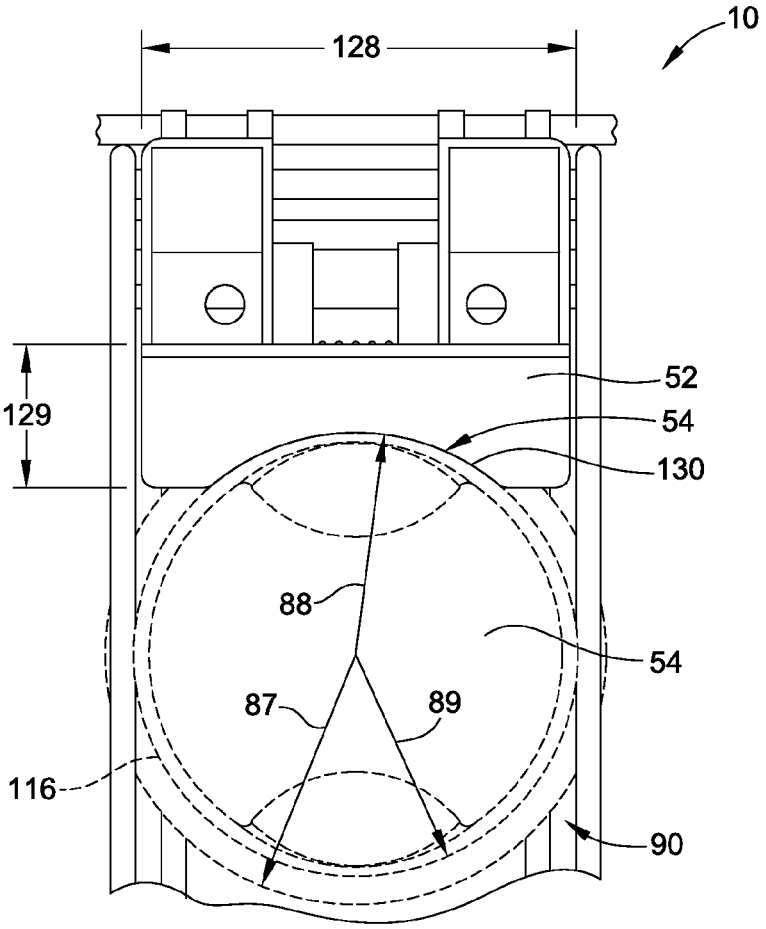
FIG. 6 is a top view of the pusher illustrating in dashed lines a cylindrical item of retail merchandise with an outer radial surface that mates with the depression of the pusher.

Turning to the top view of the tilted pusher 20 as shown in FIG. 6, the depression 54 of the tilted pusher 20 has a radius of curvature 88 which is sized to approximate the radius of curvature 89 of a generally cylindrical item of retail merchandise 90 positioned within the retail merchandise support depression 54. Thus, it can be readily appreciated that the cylindrical outer surface 116 of the can 90 mates with and is received by the retail merchandise support depression 54 of the tilted pusher 20. The radius of curvature 88 of the retail merchandise support depression 54 is sized to approximate a radius of curvature 89 of a generally cylindrical item of retail merchandise 90 such that the generally cylindrical item of retail merchandise 90 is received within the retail merchandise support depression 54. The retail merchandise support depression 54 does not extend the entire depth 129 of the top wall 52 nor does it extend the entire width 128 of the top wall 52.

Figure 7:
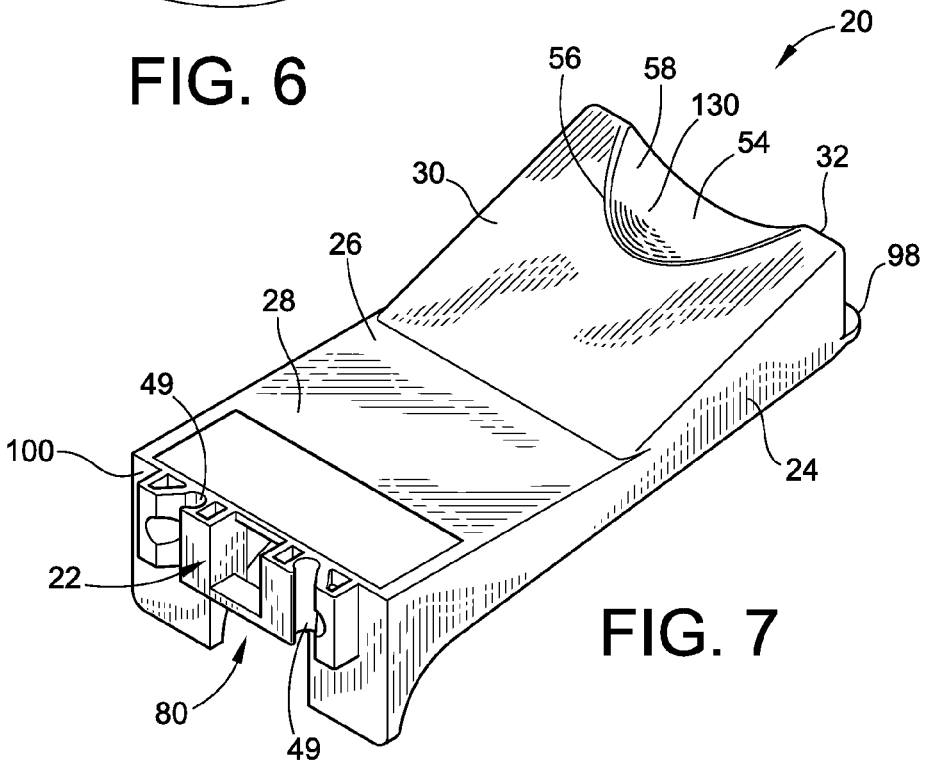
FIG. 7 is a perspective view of the pusher of the tray illustrating the front face, the depression for receiving a cylindrical item of retail merchandise, and the bottom attachment arrangement.

Turning now to FIG. 7, bottom wall 22 of the tilted pusher 20 is illustrated. The bottom wall 22 of the at least one tilted pusher 20 includes an attachment arrangement 48. The attachment member 48 includes a pair of apertures 49. Each aperture 49 permits a snap fit of a one of the plurality of longitudinal members 60 of the base structure 12. (See FIG. 5). Pins 104 assist in securing the tilted pusher 20 to the base 12. (See FIG. 5). However, the snap fit of the tilted pusher 20 to the base 14 together with the pins 104 are such that the tilted pusher is still able to slide longitudinally forward 136 towards the front 118 of the tray 10 as biased by the biasing member 82 or manually as it is slid longitudinally back 137 towards the back 120 of the tray 10. (See FIG. 5).

Figure 8:
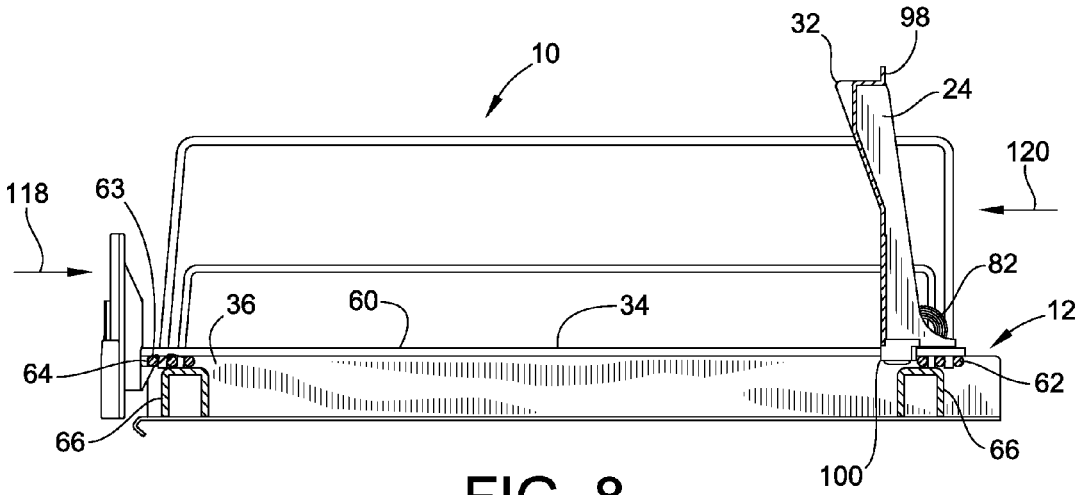
FIG. 8 is a side cross section of the tray of FIG. 1 with the pusher illustrated at the back of the tray with its biasing member in the fully extended position.

FIG. 8 is a cross sectional side view of the tray 10 and illustrates with greater particularity the rectangular support structure 36 to which the floor 34 is mounted. The rectangular support structure 36 includes at least two horizontal bar members 66 in opposed spaced relation. One of the two horizontal bar members 66 is located at the front 118 of the tray 10. The other of the two horizontal bar members 66 is located proximately at the back 120 of the tray 10. Both horizontal bar members 66 run approximately perpendicular to the plurality of longitudinal members 60.

Still referring to FIG. 8, the floor 34 is comprised of wire members that include a plurality of longitudinal members 60 in opposed spaced relationship and a plurality of horizontal members 62 in opposed spaced relationship. A portion 63 of each of the plurality of longitudinal members 60 are joined transversely to a portion 62 of each plurality of horizontal members 64.

Figure 9:
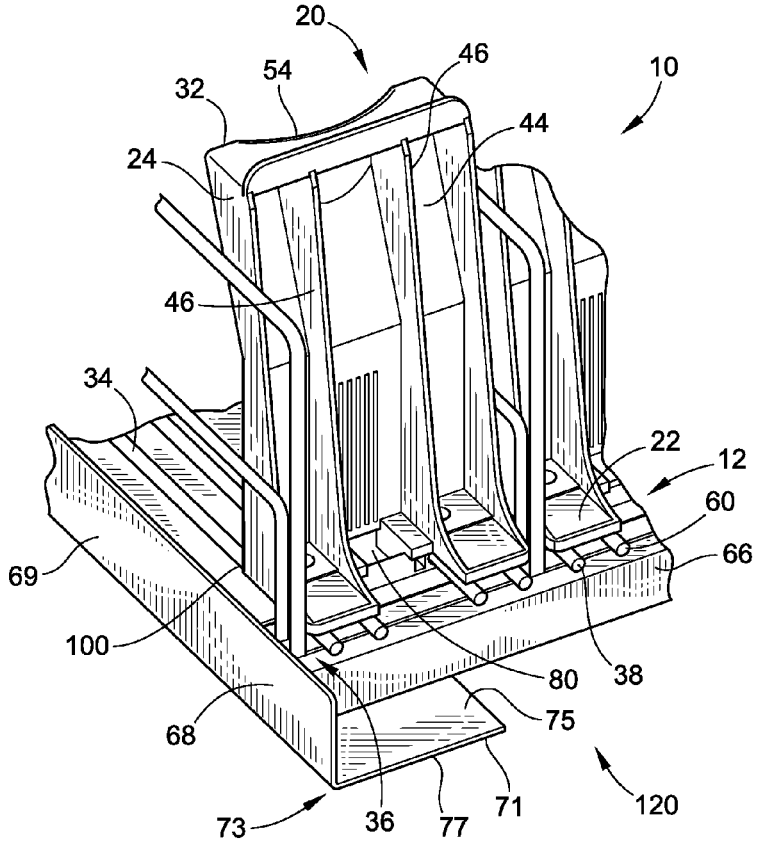
FIG. 9 is a partial perspective view of the back of the pusher and a rectangular support member of the tray.

FIG. 9 illustrates one of the at least two longitudinal corner plate members 68 in opposed space relation within the rectangular support structure 36. It can be readily appreciated that a second of the at least two longitudinal corner plate members 68, though not shown, is similarly structured. Each corner plate member 68 includes a flat vertical member 69 and a flat horizontal member 71 in proximately perpendicular relation so as to former a corner 73 therebetween. The at least two horizontal bar members 66 are mounted on a top surface of the flat horizontal member 71 in opposed space relation. That is, one of the horizontal bar members 66 is at the front 118 of the tray 10 and the other horizontal bar member 66 is at the back 120 of the tray 10. Both horizontal bar members 66 extend between, and thus proximately perpendicular to, the two flat vertical members 69 of corner plate members 68 run that run from the back 120 of the tray 10 to the front 118 of the tray 10.

Still referring to FIG. 9, the corner plate members 68 extend further towards the back 120 of the tray 10 than do the two horizontal bar members 66 so as to provide a longer and more stable base of support for the tray 10. Further, a portion of each of the corner plates 68 in the back 120 of the tray 10 is exposed, that is the horizontal bar member 66 does not mount over the top of this portion 75 of each corner plate member 68. Further, each portion 75 has an edge 77 which defines the back 120 of the tray 10. FIG. 9 further illustrates with greater particularity the back surface 44 of the tilted pusher 20. The back surface 44 of front wall 26 supports a plurality of rib members 46 in proximately parallel relation to the pair of side walls 24. Also shown is the cavity 80 that opens through part of the back surface 44 and part of the bottom wall 22 to receive the biasing member 82 (Shown in FIG. 8) therethrough.

Figure 10:
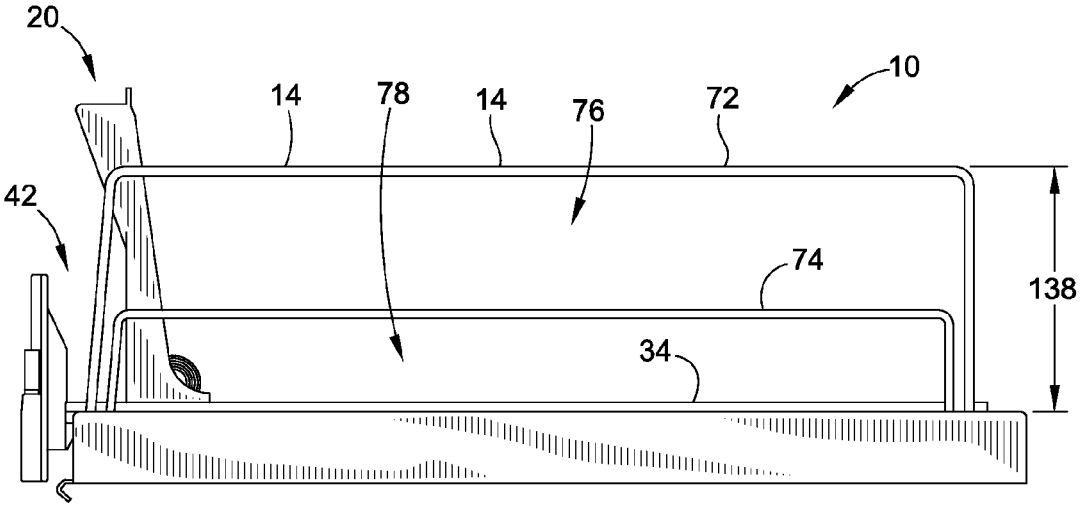
FIG. 10 is a side view of the tray with a pusher adjacent a front stop of the tray.
Figure 11:
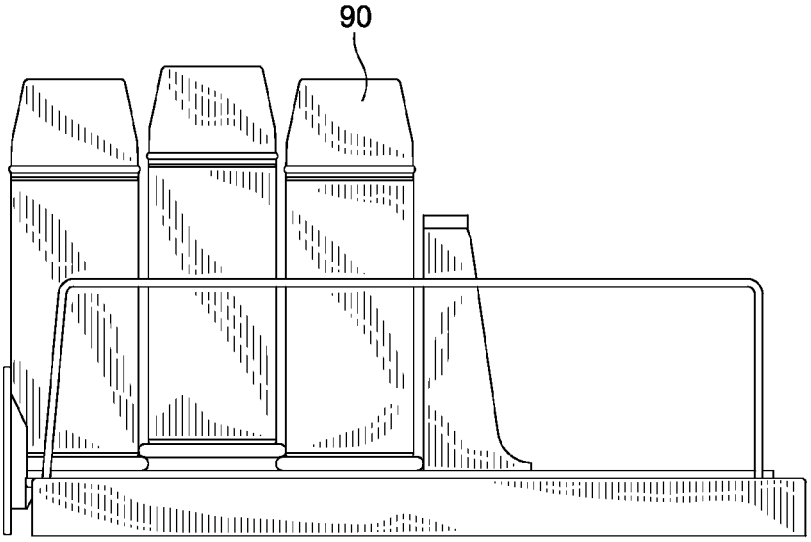
FIG. 11 PRIOR ART
FIG. 11 illustrates a conventional pusher tray with cylindrical cans mounted thereon with an intermediate can riding on the protruding rings of the bottoms of the preceding and succeeding cans.

Turning now to FIG. 10, the divider 14 of the tray 10 is described with greater particularity. Typically, the at least one divider 14 includes a pair of wire dividers 40 arranged in opposed spaced relationship to define a retail merchandise channel 42 therebetween. (See FIG. 5). Though, only one divider 14 of the pair 40 of dividers is shown it can be readily appreciated that the other divider 14 includes similar structure. Each of the wire dividers 14 in the pair 40 includes a top longitudinal wire member 72 over a bottom longitudinal wire member 74 in opposed spaced relation. A first viewing window 76 is provided in each divider 14 between the top 72 and bottom 74 longitudinal wire members and a second viewing window 78 is provided between the bottom longitudinal wire member 74 and the floor 34. The divider 14 has a vertical height 138 above floor 34. The divider's height 138 provides advantageous lateral support to the cylindrical outer surface 116 of the retail merchandise 90 to maintain the proper positioning within the retail merchandise channel 42 so as to allow a single can 90 of retail merchandise to be lifted out of the retail merchandise channel 42 without its protruding ring 102 lifting any other can 90. (See. FIG. 4).

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A retail merchandise pusher tray, comprising:

a base structure;

at least one divider mounted to the base structure and extending upwardly therefrom;

a front stop mounted at a front end of the base structure; and at least one pusher slidably mounted to the base structure, the at least one pusher comprising:

a bottom wall;

a top wall in opposed spaced relation to the bottom wall;

a pair of sidewalls extending upwardly from the bottom wall in opposed spaced relation and interposed between the bottom wall and the top wall;

a front wall extending upwardly from the bottom wall to an upper most edge; and wherein a depression is formed at the upper most edge such that the depression forms a portion of the front wall and a portion of the top wall; and wherein the uppermost edge extends forward of a forward most edge of the bottom wall.

2. The tray of claim 1, wherein the base structure includes a rectangular support structure;

a floor supported by the rectangular support structure;

wherein the floor is comprised of wire members including:

a plurality of longitudinal members in opposed spaced relationship;

a plurality of horizontal members in opposed spaced relationship; and wherein a portion of each of the plurality of longitudinal members are joined transversely to a portion of each plurality of horizontal members.

3. The tray of claim 2, wherein the rectangular support structure includes:

at least two horizontal bar members in opposed space relation;

at least two longitudinal corner plate members in opposed space relation; and wherein the at least two horizontal bar members are each joined to the at least two longitudinal corner plate members proximate to ends thereof.

4. The tray of claim 1, wherein the front stop is curved.

5. The tray of claim 1, wherein the at least one divider includes a pair of wire dividers; each divider including a top longitudinal wire member over a bottom longitudinal wire member in opposed space relation; and wherein a first viewing window is provided between the top and bottom longitudinal wire members and a second viewing window is provided between the bottom longitudinal wire member and the floor.

6. The tray of claim 1, wherein the pusher includes a cavity that provides for a biasing member, a terminus end of the biasing member extendable through an attachment member of the bottom wall to the front end stop.

7. The tray of claim 1, wherein the depression has a radius of curvature sized to approximate a radius of an item of retail merchandise.

* * * * *